United States Patent [19]

Langslet

[11] Patent Number: 4,886,268

[45] Date of Patent: Dec. 12, 1989

[54] BALL CAPTURING TENNIS NET ASSEMBLY

[76] Inventor: Eric B. Langslet, 4 Hilton Pl., Montvale, N.J. 07645

[21] Appl. No.: 191,364

[22] Filed: May 9, 1988

[51] Int. Cl.[4] ..... A63B 69/38

[52] U.S. Cl. ..... 273/29 A

[58] Field of Search ..... 273/29 A, 26 A, 26 D, 273/181 F, 411, 181 A, 392, 401, 29 B

[56] References Cited

U.S. PATENT DOCUMENTS

| | | | |
|---|---|---|---|
| 2,280,376 | 4/1942 | Clark | 273/29 A |
| 2,615,715 | 7/1947 | Moore | 273/29 A |
| 2,805,070 | 9/1957 | Waters | 273/181 F |
| 2,823,034 | 2/1958 | Bingham, Jr. | 273/26 A |
| 2,895,737 | 7/1959 | Blees | 273/26 A |
| 3,215,432 | 11/1965 | Lee et al. | 273/29 A |
| 3,711,092 | 1/1973 | Hogue | 273/26 A |
| 3,858,880 | 1/1975 | Graves | 273/29 A |
| 3,918,711 | 11/1975 | Bak | 273/26 A |
| 3,989,246 | 11/1976 | Brown et al. | 273/29 A |
| 4,070,018 | 1/1978 | Hodges | 273/29 A |
| 4,203,413 | 5/1980 | Hodges | 273/29 A |
| 4,243,221 | 1/1981 | Godinho | 273/29 A |
| 4,256,303 | 3/1981 | Dobbins | 273/29 A |
| 4,568,089 | 2/1986 | Jenkins et al. | 273/29 A |
| 4,575,081 | 3/1986 | Cavanagh | 273/29 A |
| 4,592,547 | 6/1986 | Thaxton | 273/29 A |
| 4,643,423 | 2/1987 | Wright | 273/181 F |

FOREIGN PATENT DOCUMENTS

| | | | |
|---|---|---|---|
| 2638037 | 3/1978 | Fed. Rep. of Germany | 273/29 A |
| 384786 | 12/1932 | United Kingdom | 273/29 A |

*Primary Examiner*—T. Brown

*Attorney, Agent, or Firm*—Klauber & Jackson

[57] ABSTRACT

A ball capturing tennis net assembly for use with a conventional tennis net which is stretched across the center of a tennis court between two support posts so as to extend at a predetermined height above the playing surface of the tennis court, includes first and second ball capturing nets stretched between the two support posts across the center of the tennis court in substantially parallel, spaced relation to the conventional tennis net and at a height lower than the predetermined height on opposite sides of the conventional tennis net; and first and second spacer members which space the first and second ball capturing nets away from the conventional net at the center thereof, each spacer member including a base adapted to sit on the tennis court for supporting the respective spacer member, a vertical support extending upwardly from the base substantially to the lower height, a transverse member extending outwardly and away from the upper end of the vertical support, and a rope holder at the free end of the transverse member for releasably securing an upper cord of a respective ball capturing net thereto so as to space the ball capturing net from the conventional tennis net.

8 Claims, 6 Drawing Sheets

BALL CAPTURING TENNIS NET ASSEMBLY

BACKGROUND OF THE INVENTION

The present invention relates generally to the game of tennis and, more particularly, is directed to a novel tennis net assembly that is designed to capture balls inadvertently hit into a tennis net.

In the game of tennis, a center net divides the tennis court in half, and various lines define the boundaries of the tennis court. Each player hits the ball into the opponent's portion of the court, whereupon the ball is hit back and forth over the net numerous times until one opponent fails to properly return the ball to the opponent's portion of the tennis court. For example, the ball may hit the tennis net, and thereby fail to be delivered to the opponent's side of the court. In such case, the ball oftentimes, after hitting the net, rolls rearwardly approximately midway to the hitter's portion of the court. As a result, in order to start the next point, and to avoid any danger to the players, the ball must be removed from the court. The same may occur during the serve. Specifically, during the serve, if the ball hits the net, the ball may roll rearwardly midway to the server's court. This requires the server to stop serving, walk midway to the net to retrieve the ball, and then return to the service line to serve another ball. This, however, becomes disruptive of play. Further, during a practice session when a basket of balls is continuously hit, the balls that hit the net rebound in many different directions, thereby requiring much time and effort to recover them.

In view of these problems, the use of ball capturing tennis nets is known. For example, in U.S. Pat. No. 2,615,715 to Moore, a ball capturing tennis net is arranged on opposite sides of the main net, substantially parallel thereto, but at a lower height. In such case, the ball capturing tennis nets are tied to the line posts by their own ropes which run along the bottom and top edges thereof. When a ball hits the main tennis net, it moves the main tennis net and the respective ball capturing tennis net away from each other so as to open a space therebetween through which the ball falls and is captured by the ball capturing tennis net. However, the ball capturing tennis net is intended to lie flat against the main net until a ball hits the main net. Therefore, the ball must hit the main net with a sufficient velocity to result in such separation. If the ball is hit with insufficient velocity so that the main tennis net and ball capturing tennis net do not separate, the ball capturing tennis net is ineffective to catch the ball. Thus, for beginning players who do not hit the ball with much speed and/or mishit the ball, the ball capturing tennis net may be ineffective.

U.S. Pat. No. 4,243,221 discloses a ball capturing tennis net which is positioned on opposite sides of the main tennis net. In this arrangement, separate supports are provided for supporting the ball capturing tennis net and are not connected in any manner with the main tennis net. Rather, the ball capturing tennis net and is supported by the separate supports. Therefore, such arrangement is cumbersome to set up and/or remove. In addition, if it is desired to play a conventional game of tennis without the ball capturing tennis net, such ball capturing tennis net may prove to be an obstacle to the game, requiring removal of the same which, as aforesaid, is cumbersome.

U.S. Pat. No. 3,918,711 to Zak discloses a tennis training ball target and projector in which the underside of the net is turned upwardly and is spaced from the main portion of the net by rods at the center and ends thereof. However, such arrangement could not be used with a conventional tennis net since the tennis balls would roll under the tennis net at various times, requiring removal of the balls from different areas of the court. A similar arrangement is shown in U.S. Pat. No. 424,322 to Malings et al.

U.S. Pat. No. 2,280,376 to Clark shows a plurality of ball capturing nets secured at opposite end posts in spaced relation from the main net. A center post is provided, and a center bracket is attached to the center post and also to the capturing nets to space the same from the main net at the center thereof. However, this arrangement could not be used with a conventional tennis net.

Other devices which may be relevant to the present invention, but which are less pertinent than the above-described references are disclosed in U.S. Pat. Nos. 2,823,034; 3,215,432; 4,070,018; 4,203,413; 4,568,089; and 4,575,081.

OBJECTS AND SUMMARY OF THE INVENTION

Accordingly, it is an object of the present invention to provide a ball capturing tennis net assembly that overcomes the problems with the aforementioned references.

It is another object of the present invention to provide a ball capturing tennis net assembly which can be used with a conventional tennis net for capturing tennis balls hit into such conventional tennis net, without detracting from a tennis game.

It is still another object of the present invention to provide a ball capturing tennis net that is easily mountable and/or removable in spaced relation from a conventional tennis net.

In accordance with an aspect of the present invention, a ball capturing tennis net assembly for use with a conventional tennis net which is stretched across the center of a tennis court between two support members so as to extend at a predetermined height above the playing surface of the tennis court, includes an additional tennis net stretched between the two support members across the center of the tennis court in substantially parallel, adjacent relation to the conventional tennis net at a height lower than the predetermined height; and spacer means for spacing the additional tennis net away from the conventional tennis net, the spacer means including an inverted substantially U-shaped member adapted to removably sit on the conventional tennis net, at least one transverse member extending outwardly from the U-shaped member, and securing means on the at least one transverse member for releasably securing the additional tennis net to the at least one transverse member in spaced relation to the conventional tennis net.

In accordance with another aspect of the present invention, a ball capturing tennis net assembly for use with a conventional tennis net which is stretched across the center of a tennis court between two support members so as to extend at a predetermined height above the playing surface of the tennis court, includes an additional tennis net stretched between the two support members across the center of the tennis court in substantially parallel, adjacent relation to the conventional tennis net at a height lower than the predetermined height; and spacer means for spacing the additional tennis net away from the conventional tennis net, the spacer means including base means adapted to sit on the tennis court for supporting the spacer means, a vertical support extending upwardly from the base means substantially to the lower height, a transverse member extending outwardly from an upper end of the vertical support, and securing means on the transverse member for releasably securing the additional tennis net to the transverse member in spaced relation to the conventional tennis net.

In accordance with still another aspect of the present invention, a ball capturing tennis net assembly for use with a conventional tennis net which is stretched across the center of a tennis court between first and second support posts so as to extend at a predetermined height above the playing surface of the tennis court, includes an additional tennis net stretched between the first and second support posts across the center of the tennis court in substantially parallel, adjacent relation to the conventional tennis net at a height lower than the predetermined height, the additional tennis net including upper cord means for stretching the additional tennis net between the two support posts; and spacer connection means for stretching the additional tennis net between the first and second support posts and for spacing the additional tennis net away from the conventional tennis net, the spacer connection means including first and second clamps removably securable about the first and second posts at approximately the lower height, and a transverse member secured to each clamp and extending outwardly therefrom for stretching the additional tennis net in spaced relation to the conventional tennis net.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
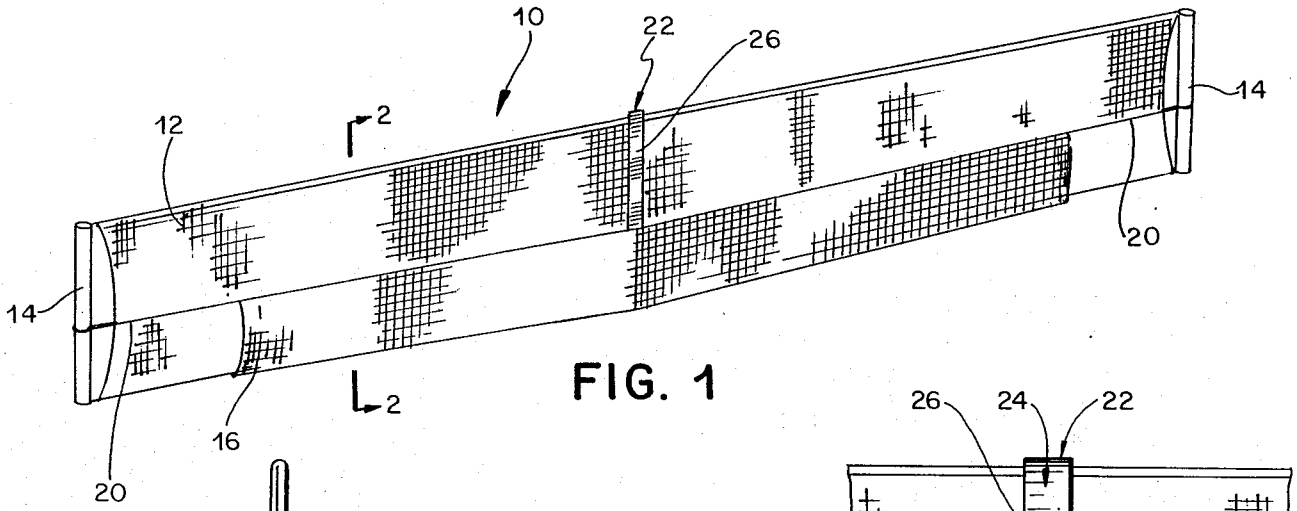
FIG. 1 is a perspective view of a ball capturing tennis net assembly according to a first embodiment of the present invention.
Figure 3:
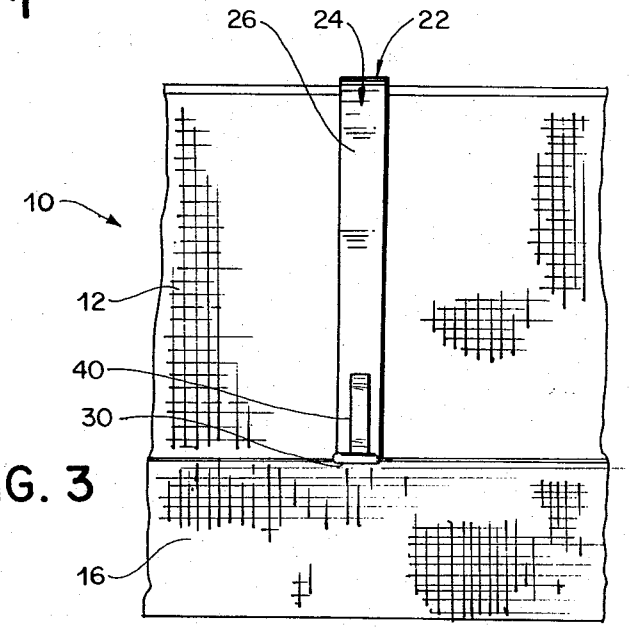
FIG. 3 is a front elevational view of a center portion of the ball capturing tennis net assembly of FIG. 1.

Referring to the drawings in detail, and initially to FIGS. 1–5 thereof, there is shown a ball capturing tennis net assembly 10 according to a first embodiment of the present invention for use with a conventional main tennis net 12 that is stretched across the center of a tennis court between two support posts 14 so as to extend at a predetermined height above the playing surface of the tennis court. Specifically, ball capturing tennis net assembly 10 includes first and second additional ball capturing tennis nets 16 and 18 stretched between support posts 14 on opposite sides of conventional tennis net 12 and across the center of the tennis court in substantially parallel, adjacent relation to conventional tennis net 12, but at a height lower than the predetermined height of main tennis net 12. Specifically, the height of each additional tennis net 16 and 18 is approximately one-third the height of main tennis net 12. Additional tennis nets 16 and 18 have a mesh structure similar to conventional tennis net 12.

Ball capturing tennis nets 16 and 18 each have an upper cord or rope 20 which extends the length thereof at the upper edge thereof. Each cord 20 is secured at opposite ends to support posts 14 by any suitable means so as to position each additional tennis net 16 and 18 substantially parallel to and against main tennis net 12. In this manner, additional tennis nets 16 and 18 are similar to the ball capturing tennis nets of U.S. Pat. No. 2,615,715 to Moore.

Figure 2:
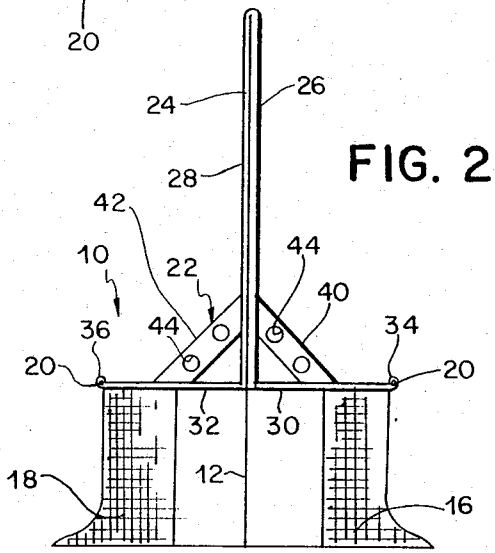
FIG. 2 is a cross-sectional view of the ball capturing tennis net assembly of FIG. 1, taken along line 2—2 thereof.
Figure 4:
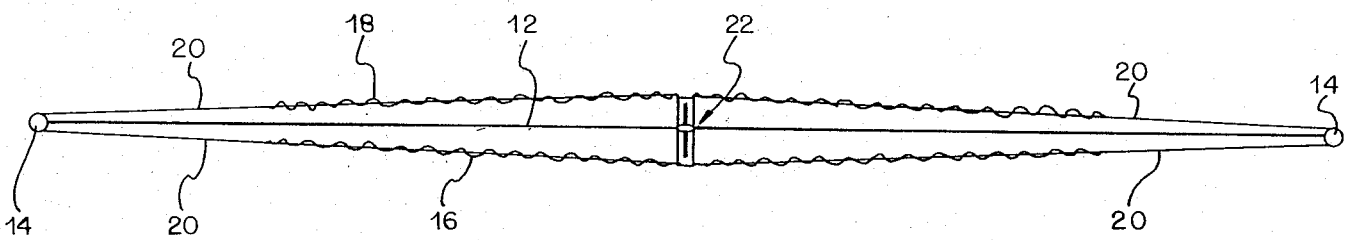
FIG. 4 is a top plan view of the ball capturing tennis net assembly of FIG. 1.

In accordance with the present invention, a ball capturing tennis net assembly 10 includes a spacer member 22 for moving each additional tennis net 16 and 18 away from main tennis net 12, as shown best in FIGS. 2 and 4. Spacer member 22 is shown in perspective view in FIG. 5, apart from main tennis net 12 and additional tennis nets 16 and 18. Basically, spacer member 22 is an integral plastic member and includes an elongated, inverted U-shaped member 24 having parallel, downwardly extending legs 26 and 28 connected at their upper ends by a connecting leg 27. Inverted U-shaped member 24 fits over and sits upon the top of main tennis net 12, as shown best in FIGS. 1–3. Accordingly, inverted U-shaped member 24 is supported by main tennis net 12 at the center thereof. Transverse spacer brackets 30 and 32 extend substantially perpendicular to and outwardly from the free lower ends of legs 26 and 28 and terminate in cylindrical rope holders 34 and 36, respectively, each having a through hole 38 therein. In order to provide structural rigidity to spacer member 24, angled bracket supports 40 and 42 connect legs 26 and 28 to transverse members 30 and 32, respectively. Each angled bracket support 40 and 42 includes air holes 44 therein to reduce the weight thereof and to prevent the wind from applying a swaying force to angled bracket supports 40 and 42, and thereby to the nets.

As aforementioned, spacer member 22 sits on the upper edge of main tennis net 12 at the center thereof. Upper ropes or cords 20 of additional tennis nets 16 and 18 fit through bores 38 of rope holders 34 and 36 and are supported thereby so as to space additional nets 16 and 18 from main tennis net 12 at the center thereof. Since said spacer member 22 is only at the center of main net 12, such spacing decreases toward end support posts 14.

In order to provide easy removability of spacer member 22 from main tennis net 12, without removing additional tennis nets 16 and 18, upper cords 20 can be cut at the center thereof to provide two free ends at the center thereof which can be secured individually through the respective bore 38 and tied thereat so as to support additional tennis nets 16 and 18 at the center of main tennis net 12. Alternatively, cylindrical rope holders 34 and 36 can be cut along the length thereof so as to provide a slot 46, as shown in dashed lines in FIG. 5 through which upper cords 20 can be inserted. In the latter case, upper cords 20 need not be cut at the center thereof. It will further be appreciated that any other suitable securing means at the end of transverse spacer brackets 30 and 32 can be provided for securing the upper edge of additional tennis nets 16 and 18 thereto in spaced relation to the center of main tennis net 12.

Thus, with the present invention, a ball capturing net assembly 10 is provided which can be used in a conventional tennis game, without detracting from the game. Further, when a server serves a ball which hits the net and remains on the server's side of the net, such ball falls down into the space between main tennis net 12 and the respective additional tennis net 16 or 18. Therefore, there is no delay between the first and second serves since the server need not have to walk across the court to pick up the faultily served ball and remove it from the court. In addition, any danger from a loose ball on the court is eliminated. If it is desired to play without ball capturing tennis net assembly 10, it is easy to remove spacer member 22, whereupon additional tennis nets 16 and 18 are maintained in contact with main tennis net 12 so as not to detract from the play.

Figure 6:
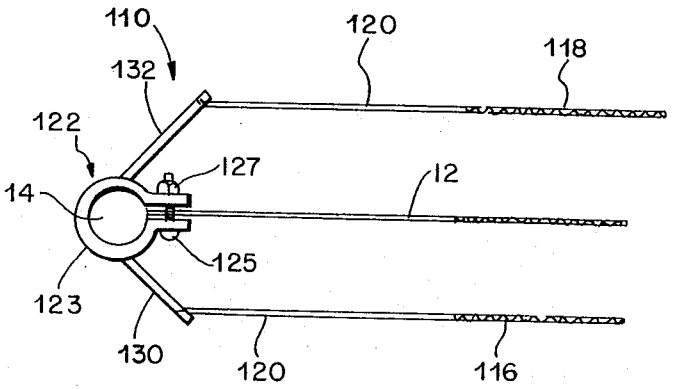
FIG. 6 is a top plan view of a portion of a ball capturing tennis net assembly according to another embodiment of the present invention.

Referring now to FIG. 6, a ball capturing tennis net assembly 110 according to a second embodiment of the present invention will now be described for use with main tennis net 12 which is stretched between end posts 14 in the same manner as described in the embodiment of FIGS. 1–5.

Specifically, ball capturing tennis net assembly 110 includes first and second additional tennis nets 116 and 118 which are substantially identical to additional tennis nets 16 and 18 in the embodiment of FIGS. 1–5.

In accordance with the embodiment of FIG. 6, ball capturing tennis net assembly 110 includes two spacer members 122 which serve a two-fold purpose, namely, for stretching the additional tennis nets 116 and 118 between support posts 14 and for spacing the additional tennis nets 116 and 118 away from main tennis net 12. Both spacer members 122 are identical, and accordingly, only one such spacer member 122 will be discussed.

As shown in FIG. 6, spacer member 122 includes clamps 123 securable about posts 14 at a height corresponding to the height of said additional tennis nets 116 and 118. Each clamp 123 can be a conventional-type clamp, such as a C-shaped clamp which extends about post 14 and has its free ends secured together by a bolt 125 and nut 127. Each clamp 123 further has transverse spacer members 130 and 132 extending outwardly therefrom. Preferably, transverse spacer members 130 and 132 extend at an angle of approximately 45° degrees with main tennis net 12. With this arrangement, upper cords 120 of additional tennis nets 116 and 118 are secured to the free ends of transverse spacer members 130 and 132, respectively by any suitable means. For example, each transverse spacer member 130 and 132 can have a suitable aperture through which upper cords 120 extend and are tied. Alternatively, notches or the like or any other suitable arrangement can be used by which upper cords 120 can be secured to the free end of transverse spacer members 130 and 132 without slipping off therefrom.

In this manner, additional tennis net 116 is secured by the free ends of upper cord 120 to transverse spacer members 130 at opposite support posts 14 so as to stretch additional tennis net 116 between support posts 14 and so as to space additional tennis net 116 away from main tennis net 12. In a similar manner, additional tennis net 118 is stretched between support posts 14 and spaced from conventional tennis net 12 by securing upper cord 120 thereof to transverse spacer members 132 at opposite support posts 14.

Figure 7:
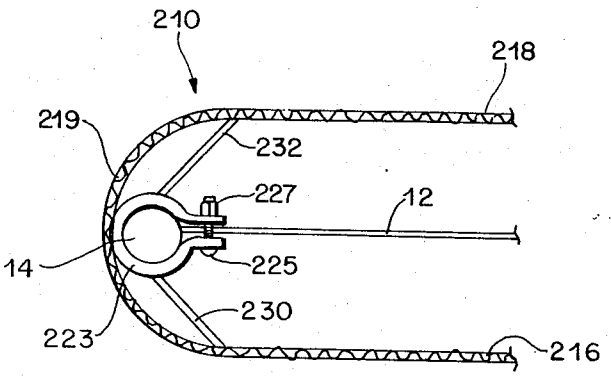
FIG. 7 is a top plan view of a portion of a ball capturing tennis net assembly according to still another embodiment of the present invention.
Figure 5:
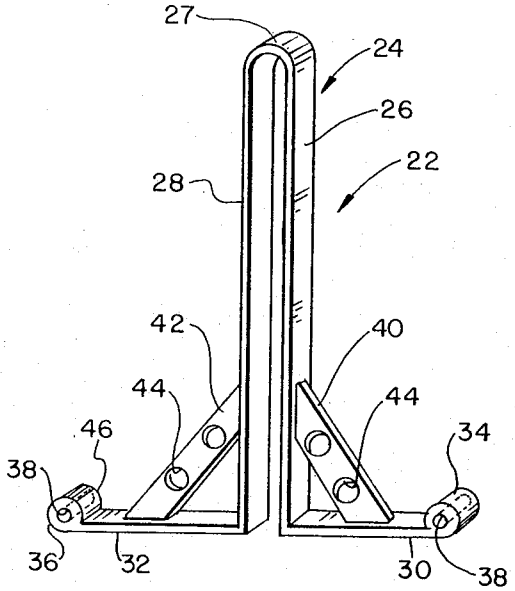
FIG. 5 is a perspective view of the spacer member of the ball capturing tennis net assembly of FIG. 1.
Figure 8:
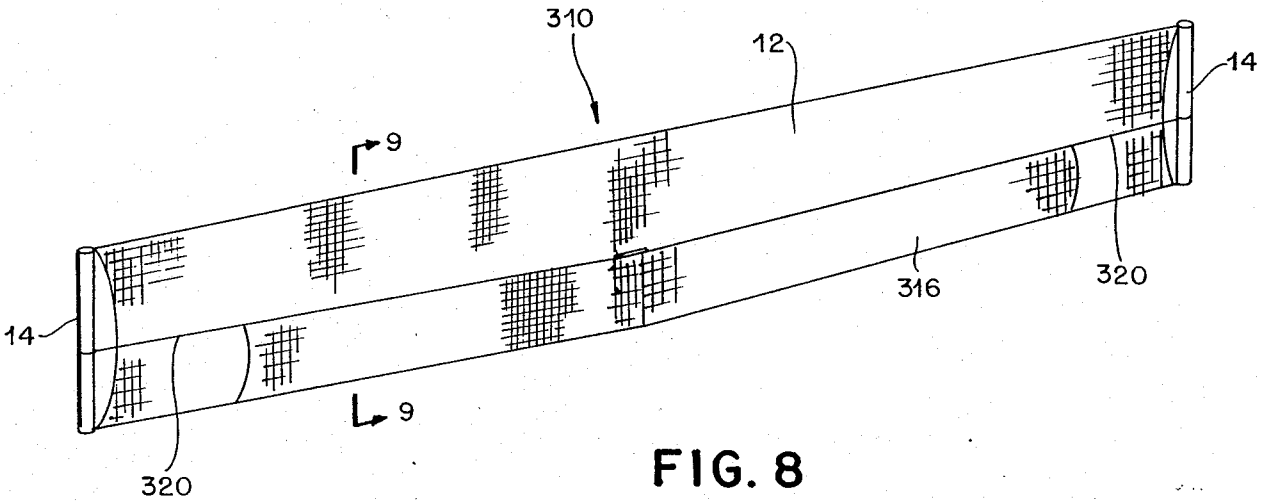
FIG. 8 is a perspective view of a ball capturing tennis net assembly according to yet another embodiment of the present invention.

Referring now to FIG. 7, a ball capturing tennis net assembly 210 according to still another embodiment of the present invention will now be described, in which elements corresponding to those in the embodiment of FIG. 6 are identified by the same reference numerals augmented by 100 and a detailed description thereof will be omitted herein for the sake of brevity. Basically, ball capturing tennis net assembly 210 differs from ball capturing tennis net assembly 110 by extending additional tennis nets 216 and 218 at their ends by an end tennis net 219 so as to form one additional tennis net in the form of a continuous loop. In this manner, such continuous additional tennis net is merely looped about transverse spacer members 230 and 232 and clamps 223, as shown, whereby such additional tennis net is supported thereby and also spaced away from main tennis net 12. Since there is no actual tying connection, such as by upper cords 120 as in the aforementioned embodiments, setting up and/or removal of such additional tennis net becomes relatively easy and straightforward.

Referring now to FIGS. 8–13, a ball capturing tennis net assembly 310 according to yet another embodiment of the present invention will now be described in which elements corresponding to those in the embodiment of FIGS. 1–5 are identified by the same reference numerals, augmented by 300, and a detailed description thereof will be omitted herein for the sake of brevity.

Specifically, ball capturing tennis net assembly 310 includes first and second additional tennis nets 316 and 318 which are identical to additional tennis nets 16 and 18 in the embodiment of FIGS. 1–5 and are secured to support posts 14 in the same manner. However, with ball capturing tennis net assembly 10 of FIGS. 1–5, spacer member 22 sits on top of main tennis net 12 and may be distracting to the play. In addition, if a tennis ball hits such spacer member 22, the ball may fly away in an undesirable direction. Alternatively, a ball which would have travelled over main tennis net 12 may hit the top of spacer member 22, thereby preventing such ball from travelling over the net. Accordingly, spacer member 322 according to the present invention extends from below and is adapted to sit upon the playing surface of the tennis court.

Figure 11:
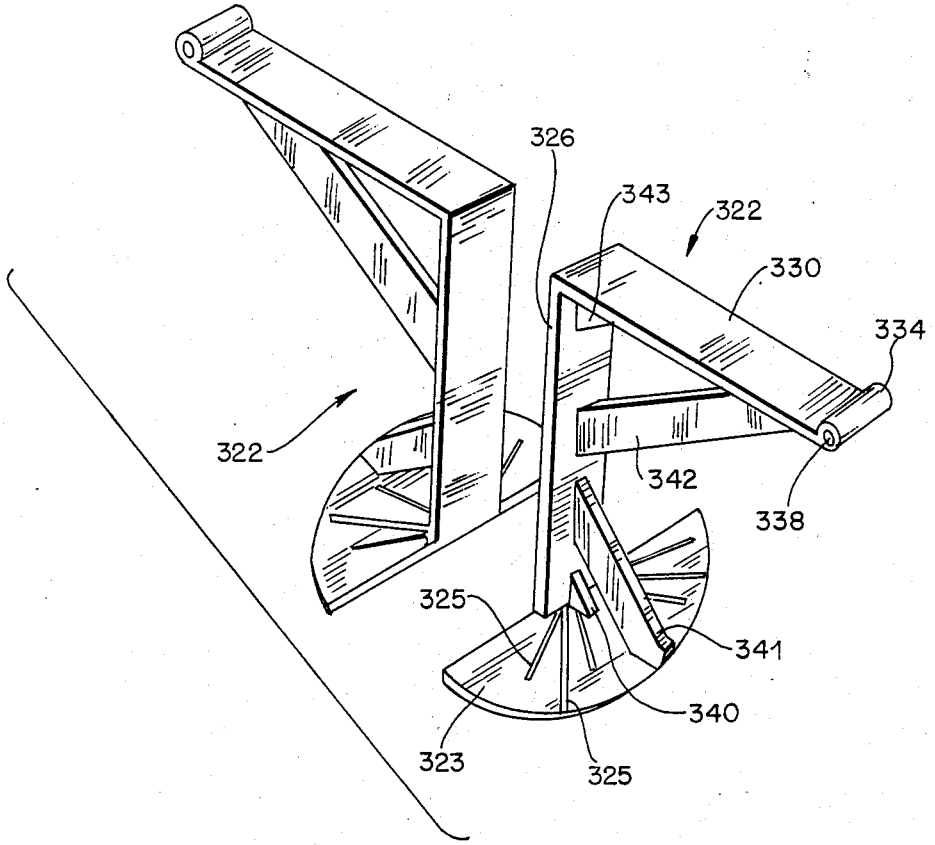
FIG. 11 is a perspective view of the spacer members of the ball capturing tennis net assembly of FIG. 8.
Figure 12:
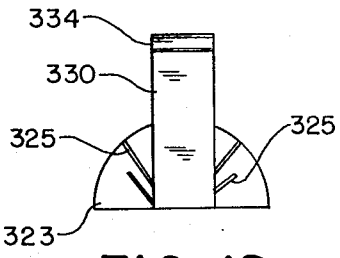
FIG. 12 is a top plan view of one of the spacer members of FIG. 11.
Figure 13:
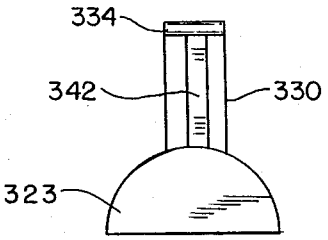
FIG. 13 is a bottom plan view of the spacer member of FIG. 12.
Figure 10:
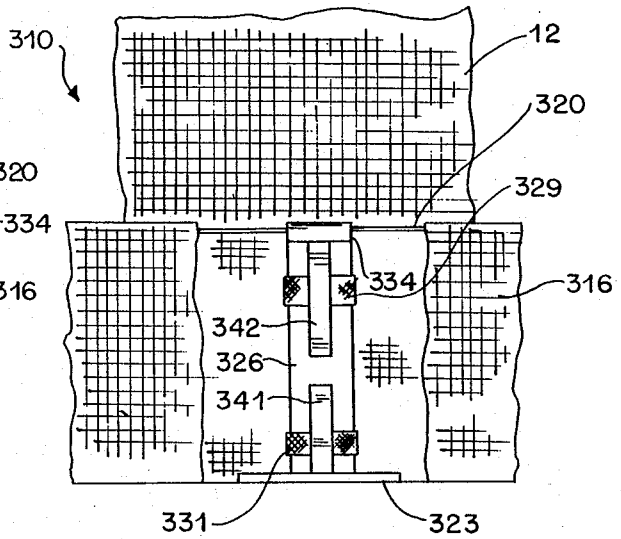
FIG. 10 is a front elevational view of a center portion of the ball capturing tennis net assembly of FIG. 8, shown partially broken away.

As shown best in FIG. 11, there are two spacer members 322, each sitting on opposite sides of main tennis net 12. Each spacer member 322 is identical, and accordingly, only one spacer member 322 will be described.

As shown best in FIG. 11, each spacer member 322 includes a base 323 adapted to sit on the playing surface of the tennis court for supporting spacer member 322. Preferably, base 323 has a semi-circular configuration and is provided with radially extending ribs 325 on the upper surface thereof for strengthening base 323. A vertically extending support 326 is connected with and extends upwardly from the center of curvature of base 323, and a transverse spacer bracket 330 extends outwardly from the upper free end of vertical support 326, and terminates in a cylindrical rope holder 334 having a through bore 338 therein. In order to provide additional support for spacer member 322, angled bracket supports 340, 341, 342 and 343 are provided, with angled bracket supports 340 and 341 extending between vertical support 326 and base 323 and angled bracket supports 342 and 343 extending between vertical support 326 and transverse spacer bracket 330.

Figure 9:
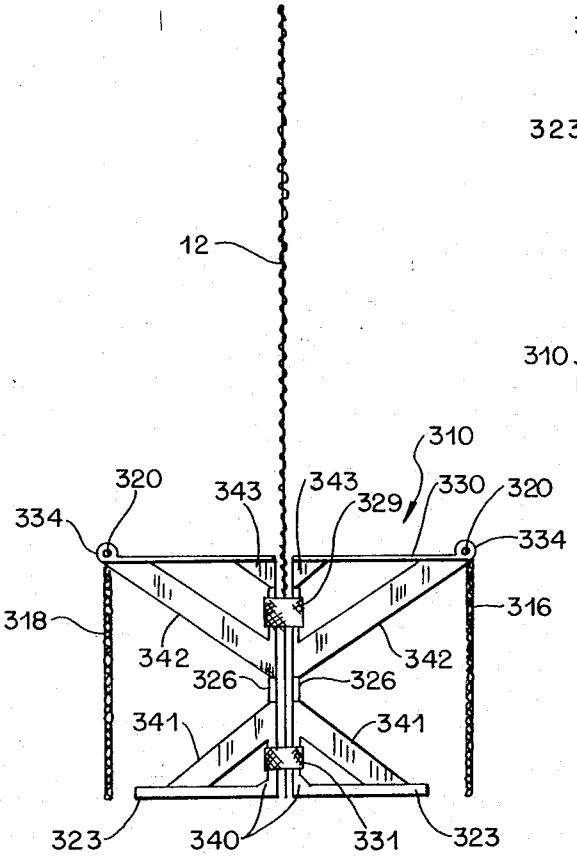
FIG. 9 is a cross-sectional view of the ball capturing tennis net assembly of FIG. 8, taken along line 9—9 thereof.

With this arrangement, a spacer member 322 is positioned on each side of main tennis net 12 at the center thereof, as shown best in FIG. 9. Then, Velcro straps or the like having a dimension that fits within the mesh of conventional tennis net 12, are inserted through such mesh and surround and secure vertical supports 326 of the two spacer members 322 together. As shown, there is an upper Velcro strap 329 and a lower Velcro strap 331 for securing spacer members 322 together. With spacer members 322 so positioned, upper cords 320 of additional tennis nets 316 and 318 are connected through bores 338 in the same manner described previously with respect to ball capturing tennis net assembly 10 so as to space additional tennis nets 316 and 318 from conventional tennis net 12. With this arrangement, there is no obstruction from spacer members 322, as may occur with spacer member 22 in the embodiment of FIGS. 1–5.

Having described specific preferred embodiments of the invention with reference to the accompanying drawings, it will be appreciated that the present invention is not limited to those precise embodiments, and that various changes and modifications can be effected therein by one of ordinary skill in the art without departing from the spirit or scope of the invention as defined by the appended claims.

What is claimed is:

1. A ball capturing tennis net assembly for use with a conventional tennis net which is stretched across the center of a tennis court between two support members so as to extend at a predetermined height above the playing surface of the tennis court, said ball capturing tennis net assembly comprising:

a) a first ball capturing net stretched between said two support members across the center of the tennis court in substantially parallel, spaced relation to said conventional tennis net at a height lower than said predetermined height said first ball capturing net having opposite end, each said end having means for connection with a said support member; and b) spacer means for spacing said first balls capturing net away from said conventional tennis net, said spacer means being positioned between opposite ends of said ball capturing net, said spacer means including:

i) base means for supporting said spacer means on a tennis court.

ii) a vertical support extending upwardly from said base means substantially to said lower height, iii) a transverse member extending outwardly from the upper end of said vertical support and away from said conventional tennis net, and iv) securing means on said transverse member for releasably securing said first balls capturing net to said transverse member in spaced relation to said conventional tennis net.

2. A ball capturing tennis net assembly according to claim 1; wherein said base means includes at least one rib thereon for increasing the structural stability of said base means.

3. A ball capturing tennis net assembly according to claim 1; wherein said means for connection of said first ball capturing net includes upper cord means for stretching said first ball capturing net between said two support members; and said securing means includes a cylindrical rope holder having a through bore for receiving said upper cord means to releasably secure said first ball capturing net to the transverse member in spaced relation to the conventional tennis net.

4. A ball capturing tennis net assembly according to claim 1; further comprising a second ball capturing net stretched between said two support members across the center of the tennis court in substantially parallel, spaced relation to said conventional tennis net at a height lower than said predetermined height and on an opposite side of said conventional tennis net from said first ball capturing net, said second, ball capturing net having opposite ends, each said and having means for connection with a said support member; and said spacer means also spacing said second ball capturing net away from said conventional tennis net.

5. A ball capturing tennis net assembly according to claim 4; wherein said spacer means includes second base means for supporting said spacer member on said tennis court on the opposite side of said conventional net from said first-mentioned base means a second vertical support extending upwardly from said second base means substantially to said lower height, a second transverse member extending outwardly from an upper end of said second vertical support and away from said conventional tennis net and second securing means on said second transverse member for releasably securing said second ball capturing net to said second transverse member in spaced relation to said conventional tennis net.

6. A ball capturing tennis net according to claim 5; wherein said spacer means further includes strap means for securing said first-mentioned and second vertical supports together through said conventional tennis net.

7. A ball capturing tennis net assembly for use with a conventional tennis net which is stretched across the center of a tennis court between two support members so as to extend at a predetermined height above the playing surface of the tennis court, said ball capturing tennis net assembly comprising:

a) a first ball capturing net stretched between said two support members across the center of the tennis court in substantially parallel, spaced relation to said conventional tennis net at a height lower than said predetermined height, said first ball capturing net having opposite ends, each said end having means for connection with a said support member; and b) spacer means for spacing said first ball capturing net away from said conventional tennis net, said spacer means including:

i) base means for supporting said spacer means on a tennis court said base means having a semi-circular configuration, ii) a vertical support extending upwardly from said base means substantially to said lower height, iii) a transverse member extending outwardly from an upper end of said vertical support and away from said conventional tennis net, and iv) securing means on said transverse member for releasably securing said additional tennis net to said transverse member in spaced relation to said conventional tennis net.

8. A ball capturing tennis net assembly according to claim 7; wherein said vertical support extends upwardly from the center of curvature of said base means substantially to said lower height.

* * * * *